US006568229B1

(12) United States Patent
Heinrich

(10) Patent No.: US 6,568,229 B1
(45) Date of Patent: May 27, 2003

(54) KEY OPERATED SWITCH HAVING REMOVABLE CLIP RETAINED SWITCH ASSEMBLY

(75) Inventor: Thomas Heinrich, Streamwood, IL (US)

(73) Assignee: The Eastern Company, Wheeling, IL (US)

( * ) Notice: Subject to any disclaimer, the term of this patent is extended or adjusted under 35 U.S.C. 154(b) by 0 days.

(21) Appl. No.: 09/794,795

(22) Filed: Feb. 27, 2001

(51) Int. Cl.[7] ..... E05B 9/06

(52) U.S. Cl. ..... 70/370; 70/367; 70/371; 70/372; 70/451; 70/466

(58) Field of Search ..... 70/370, 371, 367, 70/451, 466

(56) References Cited

U.S. PATENT DOCUMENTS

| | | | | | |
|---|---|---|---|---|---|
| 1,853,075 | A | | 4/1932 | Norviel | 200/44 |
| 1,913,963 | A | | 6/1933 | Shinn | 70/368 |
| 2,012,996 | A | | 9/1935 | Jacobi | 70/46 |
| 2,021,241 | A | | 11/1935 | Mall | 285/161 |
| 2,060,951 | A | | 11/1936 | Rae et al. | 200/44 |
| 2,278,708 | A | | 4/1942 | Miller | 29/148 |
| 2,312,643 | A | | 3/1943 | Hoettels | 70/370 |
| 2,440,690 | A | | 5/1948 | Jacobi | 200/153 |
| 2,578,608 | A | | 12/1951 | Shull | 74/424.8 |
| 2,689,700 | A | | 9/1954 | Drury | 248/27 |
| 2,744,185 | A | * | 5/1956 | Cawley | 70/370 |
| 2,883,848 | A | * | 4/1959 | Wolniak | 70/367 |
| 2,948,141 | A | | 8/1960 | Vahlstrom | 70/370 |
| 3,297,916 | A | | 1/1967 | Wright | 317/100 |
| 4,009,357 | A | | 2/1977 | Naylor | 200/42 |
| 4,098,104 | A | | 7/1978 | Wolter | 70/406 |
| 4,147,905 | A | | 4/1979 | Scherbing | 200/44 |
| 4,227,056 | A | | 10/1980 | Johnston et al. | 200/44 |
| 4,328,691 | A | | 5/1982 | Scherbing | 70/363 |
| 4,394,551 | A | | 7/1983 | Scherbing | 200/44 |
| 4,405,843 | A | | 9/1983 | Wolniak et al. | 200/44 |
| 4,580,019 | A | | 4/1986 | Takahashi | 200/43.08 |
| 4,640,478 | A | | 2/1987 | Leigh-Monstevens | 248/27.1 |
| 4,866,964 | A | | 9/1989 | Hall | 70/369 |
| 4,873,852 | A | | 10/1989 | Neyret | 70/451 |
| 4,891,477 | A | | 1/1990 | Matsuzawa | 200/61.64 |
| 5,111,007 | A | * | 5/1992 | Miller et al. | 70/432 |
| 5,408,062 | A | | 4/1995 | Agnatovech | 200/564 |
| 5,410,899 | A | | 5/1995 | McConnell | 70/370 |
| 5,551,268 | A | | 9/1996 | Carnes et al. | 70/370 |
| 5,636,540 | A | | 6/1997 | Myers | 70/370 |
| 5,799,520 | A | * | 9/1998 | Laabs et al. | 70/360 |
| 5,820,290 | A | | 10/1998 | Galindo | 403/327 |
| 5,907,963 | A | * | 6/1999 | Myers et al. | 70/371 |
| 6,079,241 | A | * | 6/2000 | Burleigh et al. | 70/370 |
| 6,161,404 | A | * | 12/2000 | Westwinkel | 70/370 |

* cited by examiner

*Primary Examiner*—Anthony Knight
*Assistant Examiner*—Christopher Boswell
(74) *Attorney, Agent, or Firm*—David A. Burge

(57) ABSTRACT

A method and means for releasably connecting the body of an electrical component such as a switch assembly to a support housing that surrounds at least a portion of the body of the switch assembly, for example the tubular body of a key operated lock adapted to operate a switch when a key is turned in the lock. A specially configured spring clip has resilient legs that extend through slots formed in opposite sides of the support housing and into engagement with formations provided on opposite sides of the body of the electrical component not only to maintain a connection between the body and the support housing but also to bias the electrical component into engagement with at least one stop formation defined by the support housing to ensure that the electrical component is properly positioned relative to the support housing.

29 Claims, 4 Drawing Sheets

KEY OPERATED SWITCH HAVING REMOVABLE CLIP RETAINED SWITCH ASSEMBLY

BACKGROUND OF THE INVENTION

1. Field of the Invention

The present invention relates to a method and means for releasably connecting the body of an electrical component such as a switch assembly to a support housing that extends alongside at least a portion of the body of the electrical component—an example being the retention and proper positioning of a generally cylindrical body of an electrical switch that extends into the open rear end region of a tubular housing of a key operated lock that is adapted to operate the switch in response to the turning of a key inserted into a plug that is carried in an open front end region of the tubular housing. More particularly, the present invention relates to the use of a spring clip to releasably retain and properly position the body of an electrical component within a support housing, wherein the spring clip has resilient legs that extend through slots formed in opposite sides of the support housing and into engagement with formations that are provided on opposite sides of the body of the electrical component 1) to provide a secure yet releasable connection between the body and the housing, and 2) to bias the body of the electrical component into engagement with at least one stop formation defined by the support housing to ensure that the electrical component is held in a proper position relative to the support housing. An optional feature resides in providing the resilient legs of the spring clip with end formations that aid in retaining the spring clip in place on the housing by extending beyond the vicinity of the slots formed in opposite sides of the support housing to define leg end configurations that require at least some deformation or deflection of the spring clip in order to remove the spring clip from the support housing—a feature that helps to ensure that the switch assembly will not become disconnected from the housing due to vibration.

2. Prior Art

It is well known in the art to utilize tubular housings to connect a variety of types of electrical components to control panels. For example, signal lights and control switches often have tubular housings that are designed to be inserted through holes formed in control panels, and secured in place by spring clips or other types of fasteners.

Key operated electrical switches, referred to as "switchlocks," are among the various types of electrical control components that often are provided with tubular housings designed to be mounted in holes formed through control panels using spring clips or threaded fasteners such as nuts. The tubular housing of a switchlock typically has 1) an open front end region that journals a plug that defines a key-receiving opening and that can be rotated relative to the housing by turning the plug with a properly configured key inserted in the key-receiving opening, and 2) an open rear end region that receives the generally cylindrical body of an electrical switch that is operated when the plug is rotated by an inserted key.

Other types of control panel mountable electrical components also are known that are supported by rear end regions of tubular housings configured to be installed in openings formed through control panels, for example non-key-operated controls such as knob-operated switches, signal lights, small acoustical enunciators and the like.

Many of the electrical components that are provided with control-panel-mountable tubular housings are permanently connected to their housings. For example, the rear end regions of the tubular housings of switchlocks often are crimped to provide secure permanent connections with the bodies of their electrical switches—or are otherwise permanently bonded or connected thereto by sonic welding or through the use of non-removable fasteners such as rivets.

Providing permanent, non-releasable connections between control-panel-mountable tubular housings and electrical components carried by rear end regions of the housings has the advantage of ensuring that the electrical components do not become disconnected from the housings due to vibration. However, these permanent connections may present serious drawbacks and disadvantages. Some control panel assembly, installation, removal, replacement and repair procedures are easier to perform if electrical components such as switch assemblies and any wires or other circuitry connected thereto can be separated from the support housings. When, for instance, a complex control panel is being assembled that is to include many closely spaced control-operated switches, it often is easier to mount the tubular support housings of these switches on the panel if the support housings have no switch assemblies (and no attendant wiring leads or other circuitry elements) connected thereto that get in the way of tools and fixtures that are needed to grip and position the support housings as fasteners such as nuts or spring clips are installed to hold the support housings in place on the control panel.

Likewise, when experimental setups of controls are to be updated by rearranging tile relative locations of switches and other electrical components, repositioning is easier to effect if the electrical components can be disconnected quickly from their support housings which are supported by an original control panel, and quickly reconnected to replacement support housings that are already mounted on a replacement control panel that orients the various electrical components in an improved arrangement or format.

It is known to utilize U-shaped spring clips to hold in place on control panels the tubular housings of switchlocks and other components that have having tubular housings. Examples of switch locks that can be held in place by U-shaped spring clips are found in such patents as U.S. Pat. Nos. 4,689,977, 4,633,689, 4,566,167, 4,427,852, 4,405,843 and 3,639,708 issued to Stanley C. Wolniak et al, referred to hereinafter as the "Switch Lock Patents," the disclosures of which are incorporated herein by reference.

It also is known to utilize a spring retainer clip to hold the rotatable plug of a lock within a surrounding tubular housing or barrel. The use of such a clip to fasten a key-receivable plug assembly within a surrounding barrel, with the retainer bridging complementary formations that are defined by the plug assembly and by the surrounding barrel is known. Features of a key-operable lock that employs such a spring-biased retaining mechanism are disclosed in U.S. Pat. No. 2,883,848 issued to Stanley C. Wolniak, referred to hereinafter as the "Permanently Assembled Lock Patent," the disclosure of which also is incorporated herein by reference.

The use of a variety of groove-carried retention members that bridge from a groove that is formed in a portion of a key-receivable plug assembly to a complimentary groove that is formed in a surrounding portion of a barrel to fasten the plug assembly in the barrel is well known. In the above-referenced Permanently Assembled Lock Patent, such complementary grooves are provided near the rear end region of the plug assembly (i.e., complementary grooves carry a bridging retainer at a location that is spaced a substantial distance rearwardly from an enlarged diameter head formation that typically is provided near the front end region of the plug assembly). In some of the invention embodiments that are disclosed in the referenced Switch Lock Patents (e.g., in U.S. Pat. Nos. 4,566,167, 4,427,852 and 4,405,843), such complementary grooves are formed in peripheral surfaces of enlarged diameter head formations of the plug assemblies, and in surrounding barrel portions (i.e., complementary grooves carry retainers at locations that are near the front ends of the plug assemblies).

A need that is not well addressed by prior proposals is the provision of an easy-to-install, easy-to-remove method and means for connecting and disconnecting electrical components such as switches to the rear end regions of tubular housings that are mountable in holes formed through control panels. This need has become increasingly pronounced as the complexity and size of electrical switches and other assemblies of electrical components that need to be operated by control-panel-mounted knobs and key-operated locks has grown, many of which are far too sizable to be inserted through holes formed in control panels—and as modern-day assembly practices have increasingly called for the tubular housings of electrical components such as key-operated switches to be mounted by automated equipment that is not well suited to feed delicate electrical devices having wires, terminals or other circuitry connected thereto.

SUMMARY OF THE INVENTION

The present invention addresses the foregoing and other needs and drawbacks of the prior art by providing a simple and inexpensive method and means for connecting the bodies of electrical components to the rear end regions of tubular support housings of the type designed for mounting in control panel openings or the like.

A feature of the present invention resides in the use it makes of a simple spring clip to provide resilient legs that are insertable through slots formed in opposite sides of the rear end region of a tubular housing and into engagement with formations provided on opposite sides of the body of an electrical switch that is at least partially surrounded by the tubular housing. The spring clip is easily installed, removed and reinstalled as may be needed to accommodate assembly, maintenance, repair and replacement procedures and the like.

A further feature of the present invention resides in the use it makes of a spring clip that performs the primary function of releasably connecting an electrical component to a tubular housing to also perform a secondary function, namely to bias the body of the electrical component toward and into engagement with at least one stop surface defined by the tubular housing. This feature is achieved by providing the housing and the body with non-aligned formations that are engaged by opposite sides of the legs of the spring clip, and by providing the resilient legs with a configuration that enables the legs to engage the non-aligned formations to effect this biasing action. Utilizing the curved legs of a spring clip to engage housing and body formations that are sufficiently aligned to permit the legs to connect the housing and the body to prevent disassembly, and yet are sufficiently non-aligned to define body and housing formations that are engaged by the legs to bias the body into engagement with a stop surface of the housing to properly position the body relative to the housing constitutes an advantageous arrangement of components that is not taught or suggested by prior proposals.

In preferred practice, a key operated switchlock has a tubular housing that carries a key operated lock assembly having a rotatable plug that extends into a forward end region of the tubular housing for operating a switch assembly having a body portion that extends into the rearward end region of the housing. The switch body is connected to the housing by a spring clip having curved leaf spring legs that not only extend into aligned slots formed on opposite sides of the housing and the body portion, but also preferably act to bias the switch assembly relative to the housing toward a seated position wherein an abutment formation connected to the switch body engages a stop formation connected to the housing.

An additional feature of preferred practice resides in the provision of distal end regions of the leaf-spring legs that aid in retaining the spring clip in place on the housing by extending beyond the vicinity of the slots to define formations that require deflection of the spring clip in order to remove the spring clip to release the connection between the switch assembly and the housing.

BRIEF DESCRIPTION OF THE DRAWINGS

These and other features, and a fuller understanding of the invention may be had by referring to the following description and claims, taken in conjunction with the accompanying drawings, wherein:

DESCRIPTION OF THE PREFERRED EMBODIMENT

Figure 1:
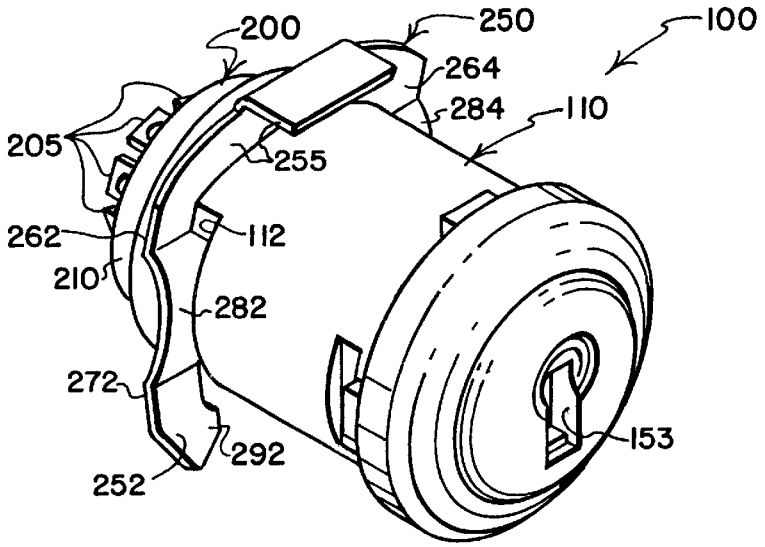
FIG. 1 is a perspective view of a key operated switch having an electrical switch assembly removably connected by a spring clip to a tubular housing, with the view showing principally front and left side portions of the assembly.
Figure 2:
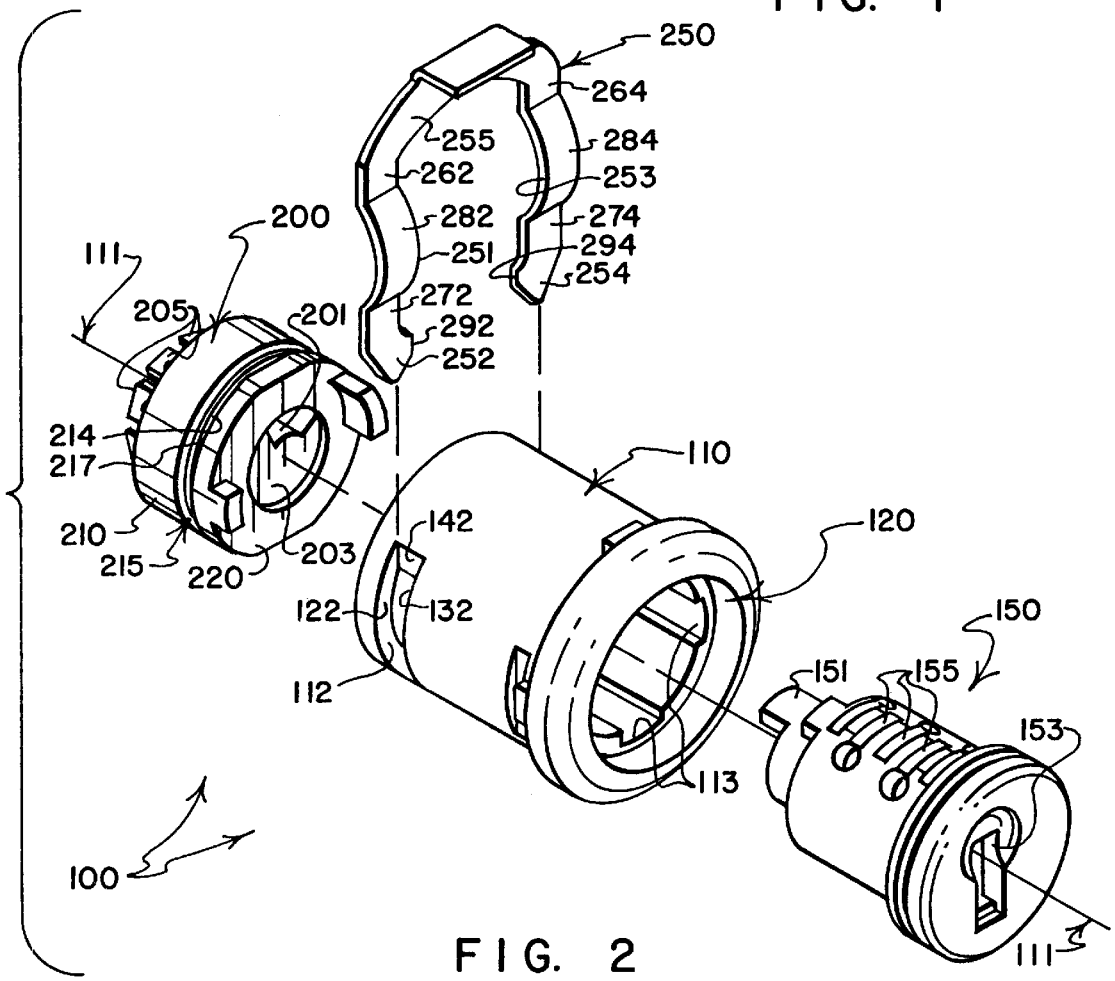
FIG. 2 is a perspective view thereof similar to FIG. 1 but exploded to better illustrate selected components.
Figure 3:
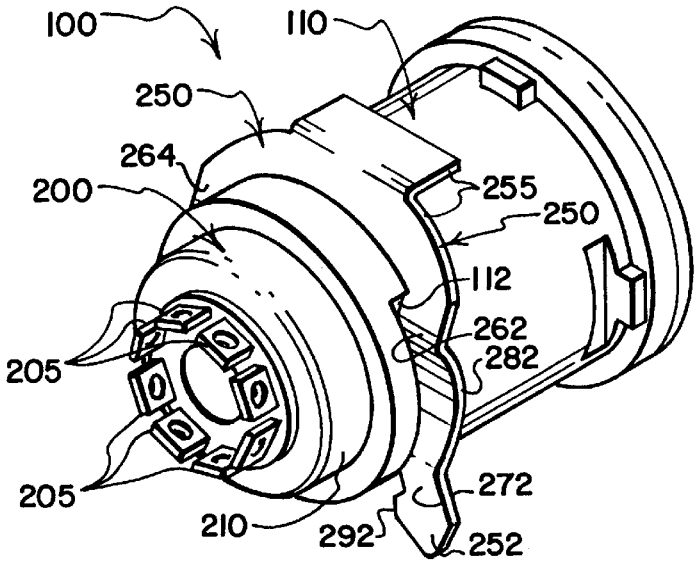
FIG. 3 is a perspective view of the assembly showing principally rear and right side portions thereof.
Figure 4:
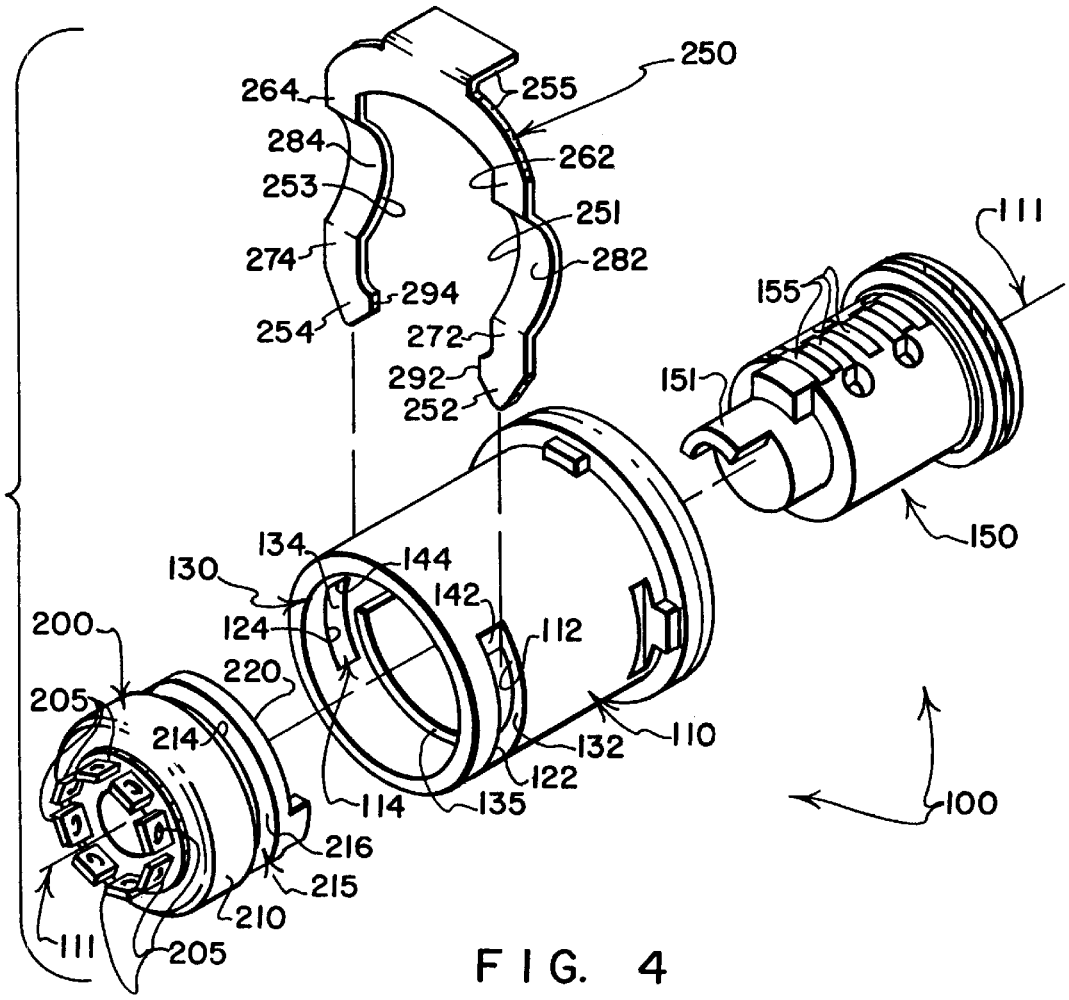
FIG. 4 is a perspective view thereof similar to FIG. 3 but exploded to better illustrate selected components.
Figure 8:
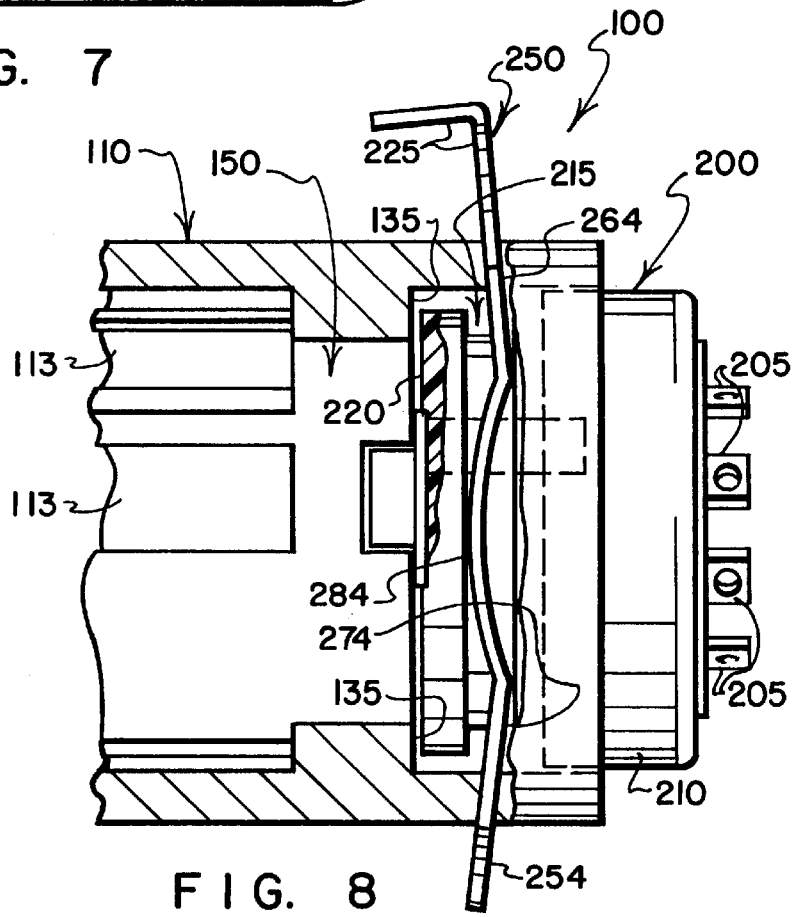

Referring to FIGS. 1 and 3, a key operated switch assembly or "switchlock" is indicated generally by the numeral 100. Referring to FIGS. 2 and 4, the assembly 100 includes a tubular housing 110, a key-receiving plug assembly 150 that is insertable into an open forward end region 120 (see FIG. 2) of the housing 110 and is rotatable about an imaginary axis 111 that extends centrally through the housing 110, an electrical switch assembly 200 which has a body 210 that is insertable part-way into an open rearward end region 130 (see FIG. 4) of the housing 110, and a U-shaped spring clip 250 for releasably connecting the switch body 210 to the tubular housing 110 so that a rearwardly extending tang 151 of the plug assembly 150 projects into a forwardly facing opening 201 (see FIG. 2) of the switch assembly 200 to rotate a rotor 203 (see FIG. 2) of the switch assembly 200 in response to rotation of the plug assembly 150 about the axis 111 by a suitably configured key (not shown) inserted into a keyway 153 (see FIGS. 1 and 2)

defined by the plug assembly 150 which retracts tumblers 155 (see FIGS. 2 and 4) carried by the plug assembly 150 from grooves 113 (see FIGS. 2 and 8) formed within the interior of the housing 110 to permit rotation of the plug assembly 150 about the axis 111.

Figure 7:
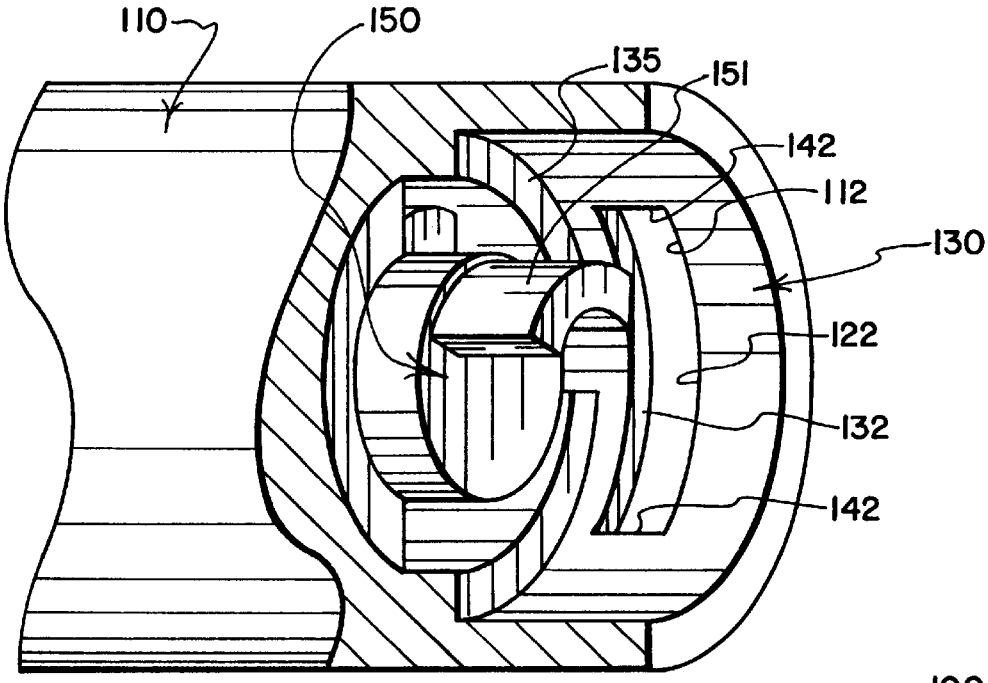
FIG. 7 is a perspective view showing selected components of the assembly with portions thereof broken away; and, FIG. 8 is a side elevational view similar to FIG. 6 but with portions of selected components broken away and shown in cross-section.

In overview, the present invention provides a simple but effective method and means for releasably retaining a cylindrical forward part of the switch body 210 within the open rear end region 130 of the housing 110 by utilizing the U-shaped spring clip 250. Referring to FIGS. 2 and 4, the spring clip 250 has spaced leaf spring legs 252, 254 that are connected by a transversely extending formation 255 of generally L-shaped cross-section. The leaf spring legs 252, 254 extend into opposed slots 112, 114 (see FIG. 4) formed in opposite sides of the housing 110, and into a groove 215 that circumferentially rings the body 210 of the switch assembly 200 to provide a releasable connection between the body 210 and the housing 110. Moreover, the leaf spring legs 252, 254 have flat portions 262, 264, 272, 274 which engage forwardly-facing side walls 122, 124 (see FIG. 4) of the slots 112, 114, respectively; and convex portions 282, 284 which engage a rearwardly-facing side wall 216 of the groove 215 to bias a front end surface 220 of the body 210 into engagement with a rearwardly facing stop surface 135 (see FIGS. 4, 7 and 8) defined within the interior of the rear end region 130 of the housing 110. The leaf spring legs 252, 254 also define inwardly projecting formations 292, 294, respectively (see FIGS. 2 and 4), that are so closely spaced that they require the U-shaped spring clip to deform or deflect slightly in order for the leaf spring legs 252, 254 to be inserted into the slots 112, 114 to the retaining or seated positions depicted in FIGS. 1 and 3, and in order for the leaf spring legs 252, 254 to be withdrawn from the slots 112, 114 after the legs 252, 254 are in the retaining positions depicted in FIGS. 1 and 3—whereby the spring clip 250 is prevented from vibrating out of the positions depicted in FIGS. 1 and 3 wherein the spring clip 250 securely couples the body 210 and the housing 110 and biases the body 210 into engagement with the stop formation 135 of the housing 110.

Inasmuch as the tubular housing 110 and the plug assembly 150 can take any of a variety of commonly known forms that utilize tumblers 155 carried by the plug 150 to define one or more relative positions of the plug 150 and the housing 110 wherein a suitably configured key (not shown) can be inserted into and removed from the keyway 153 defined by the plug 150, these components need not be further described in order for those who are skilled in the art to properly understand the purpose and preferred practice of the U-shaped retaining clip 250 and the non-aligned formations 122, 124 and 216 defined by the housing 110 and the body 210 that are engaged by the leaf spring legs 252, 254 of the U-shaped retaining clip 250 when the leaf spring legs 252, 254 are inserted into the slots 112, 114 of the housing 110 and the groove 215 of the body 210. However, it should be noted that the opposed slots 112, 114 that are formed through opposite sides of the housing 110 are substantially identical one with another, extend in a common plane (not shown) that is perpendicularly intersected by the imaginary axis 111, and have opposite side walls 122, 132 and 124, 134 that are connected by base walls 142, 144, respectively.

Figure 5:
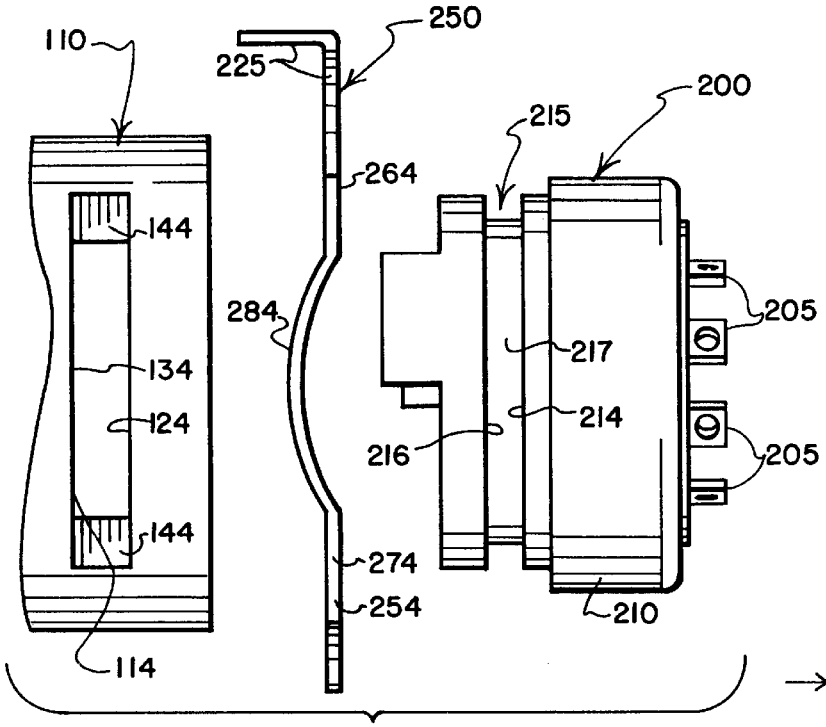
FIG. 5 is a side elevational view, on an enlarged scale, of selected components thereof disassembled.

Inasmuch as the electrical switch assembly 200 is of a common type having the generally cylindrical body 210 which protectively encloses operating components that selectively make and break connections between a plurality of terminals 205 that project rearwardly from the body 210 in response to angular positioning of the rotor 203 of the switch assembly 200 which is rotated about the axis 111 together with the plug assembly 150 when the plug assembly 150 is rotated (because the tang 151 of the plug assembly 150 extends into the rotor opening 201), the components of the switch assembly 200 need not be further described in order for those who are skilled in the art to properly understand the purpose and preferred practice of the U-shaped retaining clip 250 and the non-aligned formations 122, 124 and 216 defined by the housing 110 and the body 210 that are engaged by the leaf spring legs 252, 254 of the U-shaped retaining clip 250 when the leaf spring legs 252, 254 are inserted into the slots 112, 114 of the housing 110 and the groove 215 of the body 210. However, it should be noted that the circumferentially extending groove 215 formed in the body 210 of the switch assembly 200 has forwardly and rearwardly facing side walls 214, 216 that are interconnected at the base of the groove 215 by a generally cylindrical base wall 217 (see FIG. 5).

Referring to FIGS. 2 and 4, the leaf spring legs 252, 254 have opposed inside surfaces 251, 253, respectively, that are spaced apart just enough to slip fit alongside the base walls 142, 144 of the slots 112, 114 formed in opposite sides of the housing 110. However, the inwardly projecting end regions 292, 294 are more closely spaced than are the base walls 142, 144 of the slots 112, 114, which explains why a degree of clip deformation is needed for the projections 292, 294 to pass through the slots 112, 114 during installation and removal of the spring clip 250.

Figure 6:
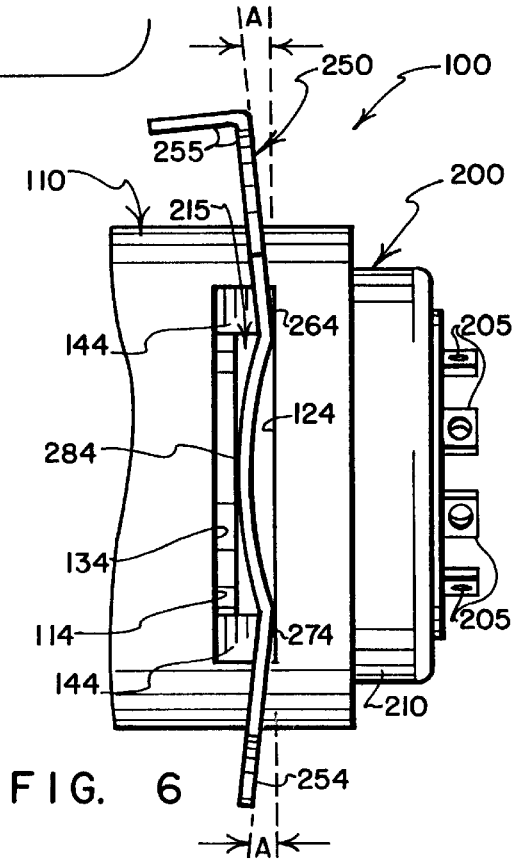
FIG. 6 is a side elevational view similar to FIG. 5 but with the components assembled.

Referring to FIG. 6, it will be seen that, when the spring clip 250 is installed, the convex surface 284 (and the convex surface 282 on the opposite side of the clip) engage the rearward facing side wall 216 of the switch body 210 to force the switch body 210 forwardly so that the front surface 220 (see FIG. 2) engages the stop formation 135 defined by the body (see FIGS. 7 and 8); and that, the flat surface portions 264, 274 (and the flat surface portions 262, 272 located on the opposite side of the clip) engage the forwardly facing surface 124 (and the forwardly facing surface 122 on the opposite side of the housing 110), with the flat surfaces 264, 274 (and the flat surfaces 262, 272 on the opposite side of the clip) being forced to incline forwardly at angles that are indicated by the letter A. In preferred practice, the legs 252, 254 of the clip 250 are configured so that, when installed, the inclination angles A equal between about five degrees and about seven degrees.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. In a key operated lock and switch assembly of the type having a tubular housing with an imaginary central axis extending centrally therethrough forwardly and rearwardly between a forward end region of the tubular housing to a rearward end region of the tubular housing, having a key operated lock connected to the tubular housing near the forward end region, and having an electrical switch assembly with a body that is configured to be inserted forwardly into the rearward end region of the tubular housing to a nested position 1) wherein the body extends between spaced sidewalls that are defined by the rearward end region at locations on opposite sides of the central axis, and 2)

wherein a forwardly facing element of the body engages at least one rearwardly facing stop formation that is defined within the tubular housing, the improvement of a coupling for releasably connecting the body to the tubular housing and for biasing a forwardly facing element of the body into engagement with the rearwardly facing stop formation, comprising 1) slots formed through the spaced sidewalls at locations on opposite site sides of the rearward end region of the tubular housing wherein each of the slots defines a forwardly facing side surface and a rearwardly facing side surface with the rearwardly facing side surface that is spaced forwardly along the central axis from the forwardly facing side surface, 2) at least one rearwardly facing wall formation defined by the body that is accessible through the slots when the body is inserted into the rearward end region of the tubular housing to the nested position and is located between the forwardly and rearwardly facing side surfaces of the slots when the body is inserted to the nested position, and 3) means for being insertable into the slots to a seated position and for being removable from the slots to releasably connect the body and the tubular housing by engaging the rearwardly facing wall formation of the body when inserted to the seated position and by disengaging the rearwardly facing wall formation of the body when removed from the slots, and for acting, when inserted to the seated position, to press against the rearwardly facing wall formation to resiliently bias the body relative to the tubular housing toward the nested position wherein the forwardly facing element of the body engages the rearwardly facing stop formation.

2. The improvement of claim 1 wherein the slots include first and second slots formed through the spaced sidewalls at locations on opposite sides of the central axis, wherein the rearwardly facing wall formation of the body includes a first rearwardly facing wall formation that is accessible through the first slot and a second rearwardly facing wall formation that is accessible through the second slot, and wherein the means for being inserted into the slots includes a first leaf spring element for being inserted into the first slot to a first seated position to engage the first rearwardly facing wall formation, and a second leaf spring element for being inserted into the second slot to a second seated position to engage the second rearwardly facing wall formation.

3. The improvement of claim 2 wherein the first and second slots extend substantially in a common plane that is perpendicular to the central axis.

4. The improvement of claim 2 additionally including means for connecting the first and second leaf spring elements so that the first and second leaf spring elements are insertable concurrently into the first and second slots, respectively.

5. The improvement of claim 2 wherein the means for being inserted into the slots takes the form of a U-shaped spring clip having spaced first and second leg portions connected by a transversely extending portion, wherein the first leg portion defines the first leaf spring element and the second leg portion defines the second leaf spring element.

6. The improvement of claim 5 wherein the first and second leg portions have convex regions that are configured to extend forwardly to engage the first and second rearwardly facing wall formations of the body, and other regions that are configured to engage the forwardly facing side surfaces of the slots to bias the body relative to the tubular housing toward the nested position.

7. The improvement of claim 6 wherein each of the first and second leaf spring elements defines one of the convex regions and two of the other regions.

8. The improvement of claim 6 wherein the other regions are located along the first and second leg portions near to and on opposite sides of the convex regions.

9. The improvement of claim 1 wherein the coupling includes a U-shaped spring clip having first and second leaf spring legs that define the means for being insertable into and removable from the slots.

10. The improvement of claim 9 wherein at least one of the first and second leaf spring legs has a central region configured to engage at least one of the first and second rearwardly facing formations defined by the body, and another region configured to engage the forwardly facing side surface of at least one of the slots to resiliently bias the body relative to the tubular housing toward the nested position.

11. A key operated lock and switch assembly, comprising:

a) a tubular housing having an imaginary central axis extending centrally therethrough forwardly and rearwardly between a forward end region of the tubular housing to a rearward end region of the tubular housing, wherein the rearward end region defines spaced sidewalls located on opposite sides of the central axis, and wherein the tubular housing defines at least one rearwardly facing stop formation therein;

b) a key operated lock mechanism connected to the tubular housing near the forward end region, including a plug that defines a keyway and is rotatable about the axis relative to the tubular housing between angularly spaced positions when a suitably configured key is inserted into the keyway;

c) an electrical switch assembly having a body that is configured to be inserted forwardly into the rearward end region of the tubular housing between the spaced sidewalls to a nested position wherein the body extends between the spaced sidewalls and wherein a forwardly facing element of the body engages the rearwardly facing stop formation, and having a rotatable operator configured to drivingly engage the rotatable plug for being rotated about the central axis with the plug to operate the electrical switch assembly when the plug is rotated between the angularly spaced positions; and, d) means for releasably connecting the body to the tubular housing and for holding the forwardly facing element of the body in engagement with the at least one rearwardly facing stop formation, comprising slots formed through the spaced sidewalls at locations on opposite sides of the rearward end region of the tubular housing wherein each of the slots defines a forwardly facing side wall and a rearwardly facing side wall, and wherein the rearwardly facing side wall is spaced forwardly along the central axis from the forwardly facing side wall, and means for being inserted into the slots to a seated position, for being adapted to extend through the slots when in the seated position to engage a rearwardly facing wall formation that is defined by the body of the electrical switch assembly to establish a connection between the body and the tubular housing when the body is in the nested position, for biasing the forwardly facing element of the body into engagement with the rearwardly facing stop formation of the tubular housing, and for being removable from the slots to disengage the rearwardly facing wall formation to release the connection between the body and the tubular housing.

12. The key operated lock and switch assembly of claim 11 wherein the slots include first and second slots formed through the tubular housing at locations on opposite sides of the central axis, wherein the rearwardly facing wall formation of the body includes first and second rearwardly facing formations located on opposite sides of the body, and wherein the means for being inserted into the slots includes a first leaf spring element for being inserted into the first slot to a first seated position to engage one of the first and second rearwardly facing wall formations on the body of the electrical switch assembly, and a second leaf spring element for being inserted into the second slot to a second seated position to engage another of the first and second rearwardly facing wall formations on the body.

13. The key operated lock and switch assembly of claim 12 wherein the first and second slots extend substantially in a common plane that is perpendicular to the central axis.

14. The key operated lock and switch assembly of claim 12 additionally including means for connecting the first and second leaf spring elements so that the first and second leaf spring elements are insertable concurrently into the first and second slots, respectively.

15. The key operated lock and switch assembly of claim 12 wherein the means for being inserted into the slots takes the form of a U-shaped spring clip having spaced first and second leg portions connected by a transversely extending portion, wherein the first leg portion defines the first leaf spring element and the second leg portion defines the second leaf spring element.

16. The key operated lock and switch assembly of claim 15 wherein the first and second leg portions have convex formations that are configured to engage the first and second rearwardly facing wall formations of the body, respectively, and other formations that are configured to engage the forwardly facing side surfaces of the first and second slots, respectively, to bias the body toward the nested position.

17. The key operated lock and switch assembly of claim 16 wherein each of the first and second leaf spring elements defines one of the convex regions and two of the other regions.

18. The key operated lock and switch assembly of claim 16 wherein the other regions are located along the first and second leg portions near to and on opposite sides of the convex regions.

19. The key operated lock and switch assembly of claim 11 wherein the coupling includes a U-shaped spring clip having first and second leaf spring legs that define the means for being insertable into and removable from the slots.

20. The key operated lock and switch assembly of claim 19 wherein at least one of the first and second leaf spring legs has a central region configured to engage at least one of the first and second rearwardly facing wall formations defined by the body, and another region configured to engage the forwardly facing side surface of at least one of the slots to resiliently bias the body relative to the tubular housing toward the nested position.

21. A key operated lock assembly adapted to be releasably connected to an electrical switch assembly, comprising:

a) a tubular housing having an imaginary central axis extending centrally therethrough forwardly and rearwardly between a forward end region of the tubular housing to a rearward end region of the tubular housing, wherein the rearward end region defines spaced sidewalls located on opposite sides of the axis that are configured to receive therebetween a body of the electrical switch assembly, and wherein the tubular housing defines at least one rearwardly facing stop formation configured to be engaged by a forwardly facing element of the body of the electrical switch assembly when the electrical switch assembly is inserted between the spaced sidewalls to a nested position;

b) a key operated lock mechanism connected to the tubular housing near the forward end region, including a plug that defines a keyway and is rotatable about the central axis relative to the tubular housing between angularly spaced positions when a suitably configured key is inserted into the keyway, wherein the plug is configured to engage the electrical switch assembly when the electrical switch assembly is inserted to the nested position for operating the electrical switch assembly when the plug is rotated by the inserted key between said angularly spaced positions; and, c) means for releasably connecting the body to the tubular housing and for holding the body in engagement with the at least one stop formation, comprising slots formed through the spaced sidewalls at locations on opposite sides of the rearward end region of the tubular housing wherein each of the slots defines a forwardly facing side surface and a rearwardly facing side surface with the rearwardly facing side surface being spaced forwardly along the central axis from the forwardly facing side surface, and means for being inserted into the slots to a seated position, for being adapted to extend through the slots when in the seated position to engage rearwardly facing wall formations that are defined by the body of the electrical switch assembly at locations between the forwardly and rearwardly facing side surfaces of the slots to establish a connection between the body and the tubular housing when the body is in the nested position, for biasing the forwardly facing element of the body into engagement with the rearwardly facing stop formation of the tubular housing, and for being removable from the slots to disengage the rearwardly facing wall formations that are defined by the body to release the connection between the body and the tubular housing.

22. The key operated lock assembly of claim 21 wherein the slots include first and second slots formed through the tubular housing at locations on opposite sides of the central axis, and wherein the means for being inserted into the slots includes a first leaf spring element for being inserted into the first slot to a first seated position to engage a first of the rearwardly facing wall formations on the body of the electrical switch assembly, and a second leaf spring element for being inserted into the second slot to a second seated position to engage a second of the rearwardly facing wall formations on the body.

23. The key operated lock assembly of claim 22 wherein the means for being inserted into the slots takes the form of a U-shaped spring clip having spaced first and second leg portions connected by a transversely extending portion, wherein the first leg portion defines the first leaf spring element and the second leg portion defines the second leaf spring element.

24. The key operated lock assembly of claim 23 wherein the first and second leg portions have convex formations that are configured to engage the first and second rearwardly facing wall formations of the body, respectively, and other formations that are configured to engage forwardly facing side surfaces of the first and second slots, respectively, to bias the body toward the nested position.

25. A key operated lock and switch assembly, comprising:

a) a generally tubular housing having a forward end region and a rearward end region spaced forwardly and rearwardly along an imaginary central axis of the tubular housing;

b) means connected to the tubular housing for defining a rearwardly facing stop formation;

c) a key operated lock extending into the forward end region of the tubular housing, and having a plug that is rotatable about the central axis between first and second angular positions;

d) means for defining an electrical switch assembly having a body that extends into the rearward end region;

e) means connected to the body for defining a forwardly facing abutment formation configured to be engaged by the rearwardly facing stop formation when the body is in a seated position relative to the tubular housing to enable the means for defining an electrical switch assembly to be drivingly engaged by the plug so as to operate the electrical switch assembly in response to rotation of the plug between the first and second angular positions; and, f) a generally U-shaped spring clip having spaced legs that are insertable into slots formed through opposite sides of the tubular housing and into engagement with rearwardly facing wall formations of the body that are accessible through the slots at locations between forwardly and rearwardly facing side walls that define opposite sides of the slots to retain the body of the means for defining an electrical switch assembly within the rearward end of the tubular housing, and to bias the body relative to the tubular housing toward a nested position wherein the forwardly facing abutment formation engages the rearwardly facing stop formation.

26. The key operated lock and switch assembly of claim 25 wherein at least one of the spaced legs has a convex portion that is engageable with the rearwardly facing wall formations defined by the body, and at least one substantially flat portion that is engageable with one of the forwardly facing side surfaces defined by the tubular housing to effect said biasing of the body relative to the housing.

27. The key operated lock and switch assembly of claim 26 wherein the flat portion is caused to be deflected when the convex portion engages one of the rearwardly facing wall formations defined by the body and the flat portion engages the one of the forwardly facing side surfaces defined by the tubular housing.

28. A key operated lock and switch assembly, comprising:

a) a generally tubular housing having a forward end regions and a rearward end region that are connected by a central region to define a chamber extending centrally forwardly and rearwardly through the tubular housing;

b) means connected to the tubular housing for defining a rearwardly facing stop formation;

c) means for defining a key operated lock within the forward end region of the chamber including a key receiving plug that is rotatable about the center axis between locked and unlocked positions, and for defining a drive formation on a rear part of the plug;

d) means for defining an electrical switch assembly having a body that extends into the rearward end region of the chamber, for defining a forwardly facing abutment formation configured to engage the rearwardly facing stop formation to locate the body in a nested position relative to the tubular housing, and for defining an operating element configured to be drivingly engaged by the driving formation of the plug for operating the electrical switch assembly in response to rotation of the plug between the locked and unlocked positions;

e) a generally U-shaped spring clip having a pair of spaced-apart, elongate, substantially parallel extending leaf spring legs that are separated by an intervening space and that are connected by a bridging portion; and, f) slots formed on opposite sides of the tubular housing, and rearwardly facing wall formations accessible through the slots at locations between forwardly and rearwardly facing side surfaces of the slots and being defined on opposite sides of the body, with the slots opening into the chamber and being aligned sufficiently with the rearwardly facing wall formations of the body to permit the leaf spring legs of the U-shaped spring clip to project through the slots of the housing into engagement with the rearwardly facing wall formations of the body to retain the body within the rearward end region of the chamber, and to engage the forwardly facing side surfaces of the slots of the tubular housing and the rearwardly facing wall formations of the body to bias the body relative to the tubular housing toward the nested position wherein the forwardly facing abutment formation engages the rearwardly facing stop formation.

29. A method of releasably connecting a body of an electrical switch assembly to a rearward end region of a tubular housing of a key operated lock assembly to provide a switch lock of the type having the key operated lock located near a forward end region of the tubular housing, comprising the steps of:

a) providing the tubular housing with slots on opposite sides thereof, wherein each of the slots defines a forwardly facing side surface and a rearwardly facing side surface, and wherein the rearwardly facing side surfaces faces are spaced forwardly from the rearwardly facing side surfaces;

b) providing the body with rearwardly facing wall formations on opposite sides thereof that are accessible through the slots at locations between the forwardly and rearwardly facing side surfaces of the slots;

c) positioning the body to extend into the rearward end region of the tubular housing with the slots formed in opposite sides of the tubular housing providing access to the rearwardly facing wall formations formed in opposite sides of the body; and, c) inserting the legs of a U-shaped spring clip into the slots and into engagement with the rearwardly facing wall formations to establish a connection between the body and the tubular housing, with the legs engaging the forwardly facing side surfaces of the slots and the rearwardly facing wall formations to bias the body relative to the tubular housing toward a position wherein a forwardly facing abutment formation connected to the body engages a rearwardly facing stop formation connected to the tubular housing to properly locate the electrical switch assembly relative to the tubular housing so the electrical switch assembly can be operated in response to operation of the lock.

* * * * *